US011787026B2

(12) United States Patent
Ou

(10) Patent No.: US 11,787,026 B2
(45) **Date of Patent: *Oct. 17, 2023**

(54) RATCHET TOOL

(71) Applicant: Yu-Hua Ou, Taichung (TW)

(72) Inventor: Yu-Hua Ou, Taichung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 17/568,039

(22) Filed: Jan. 4, 2022

(65) Prior Publication Data

US 2023/0211481 A1 Jul. 6, 2023

(51) Int. Cl.
*B25B 23/142* (2006.01)
*B25B 23/14* (2006.01)
*B25B 15/04* (2006.01)

(52) U.S. Cl.
CPC ..... *B25B 23/1427* (2013.01); *B25B 15/04* (2013.01); *B25B 23/141* (2013.01)

(58) Field of Classification Search
CPC . B25B 23/1427; B25B 23/142; B25B 23/141; B25B 23/14; B25B 23/1405; B25B 23/0042; B25B 15/04; B25B 13/466
USPC ..... 81/472; 464/32, 37
See application file for complete search history.

(56) References Cited

U.S. PATENT DOCUMENTS

| | | | | |
|---|---|---|---|---|
| 8,276,487 | B2 * | 10/2012 | Wengreen | B25B 23/1427 81/477 |
| 10,315,296 | B2 * | 6/2019 | Victor | B25B 23/147 |
| 11,173,583 | B2 * | 11/2021 | Ge | B25B 15/04 |
| 2011/0092295 | A1 * | 4/2011 | Wernz | B25B 23/1427 464/37 |
| 2015/0252855 | A1 * | 9/2015 | Jakoubek | B25B 23/141 464/37 |
| 2017/0105813 | A1 * | 4/2017 | Rash | A61B 17/8875 |
| 2019/0022833 | A1 * | 1/2019 | Macke | B25B 13/463 |
| 2020/0282530 | A1 * | 9/2020 | Sharifi-Mehr | B25B 15/04 |

* cited by examiner

*Primary Examiner* — Brian D Keller
*Assistant Examiner* — Robert C Moore
(74) *Attorney, Agent, or Firm* — Muncy, Geissler, Olds & Lowe, P.C.

(57) ABSTRACT

A ratchet tool provided, including: a driver body, including a handle and a working rod connected with the handle, at least one of the handle and the working rod being integrally formed with a first blocking structure; at least one sleeve member, being disposed around and unidirectionally rotatable about the driver body, integrally formed with a second blocking structure, at least one of the first and second blocking structures being configured as a ratcheting structure, the second blocking structure being releasably stuck with the first blocking structure in a rotation direction; wherein when there is a relative torque greater than a predetermined torque between the at least one sleeve member and the driver body, at least one of the first blocking structure and second the blocking structures deforms and the second blocking structure is slidable over the first blocking structure in the rotation direction.

2 Claims, 5 Drawing Sheets

RATCHET TOOL

BACKGROUND OF THE INVENTION

Field of the Invention

The present invention relates to a ratchet tool.

Description of the Prior Art

Generally, a tool with a handle and a screwdriver head is used to drive a fastener, such as a screw or the like, to an object, for assembling or connection. The user holds the handle and inserts the screwdriver head within a receiving hole of the fastener to facilitate turning the fastener.

It is noted that the conventional screwdriver tool does not have any torque control mechanism, which can cause failure of fastening easily and cause excessive torque to damage the fastener.

In the locking operation, if the torque applied is insufficient, it may cause the fastener to loosen, which not only causes danger but also affects its working quality; if the torque applied is excessive, the receiving hole of the fastener can be damaged, which also affects fastening effect of the fastener.

The present invention is, therefore, arisen to obviate or at least mitigate the above-mentioned disadvantages.

SUMMARY OF THE INVENTION

The main object of the present invention is to provide a ratchet tool with which it is avoided that the driven piece is damaged due overdriving of the torque tool.

To achieve the above and other objects, a ratchet tool provided, including: a driver body, including a handle and a working rod connected with the handle, at least one of the handle and the working rod being integrally formed with a first blocking structure; at least one sleeve member, being disposed around and unidirectionally rotatable about the driver body, integrally formed with a second blocking structure, at least one of the first blocking structure and the second blocking structure being configured as a ratcheting structure, the second blocking structure being releasably stuck with the first blocking structure in a rotation direction of the at least one sleeve member; wherein when there is a relative torque greater than a predetermined torque between the at least one sleeve member and the driver body, at least one of the second blocking structure and the first blocking structure deforms and the second blocking structure is slidable over the first blocking structure in the rotation direction.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
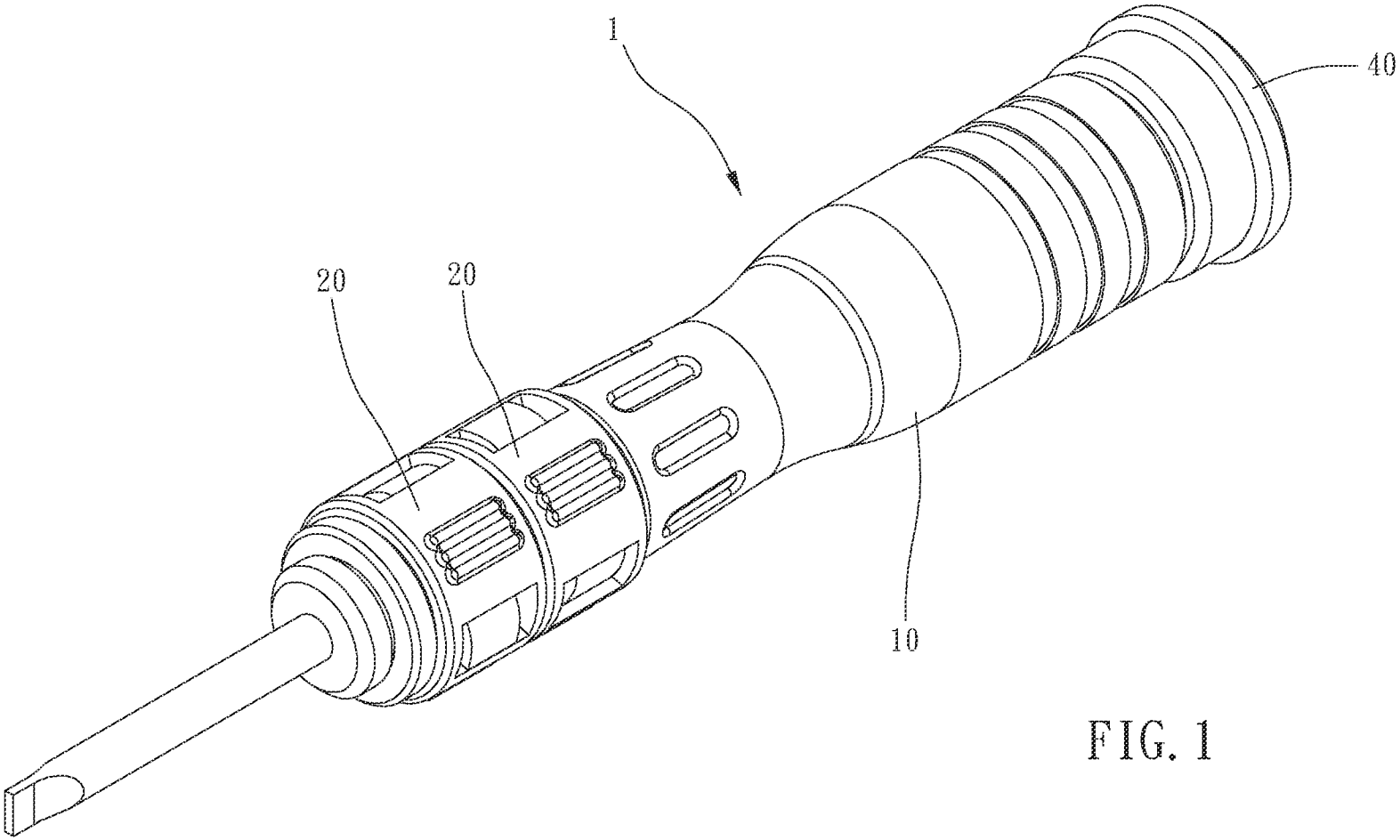
FIG. 1 is a stereogram of a preferable embodiment of the present invention.
Figure 2:
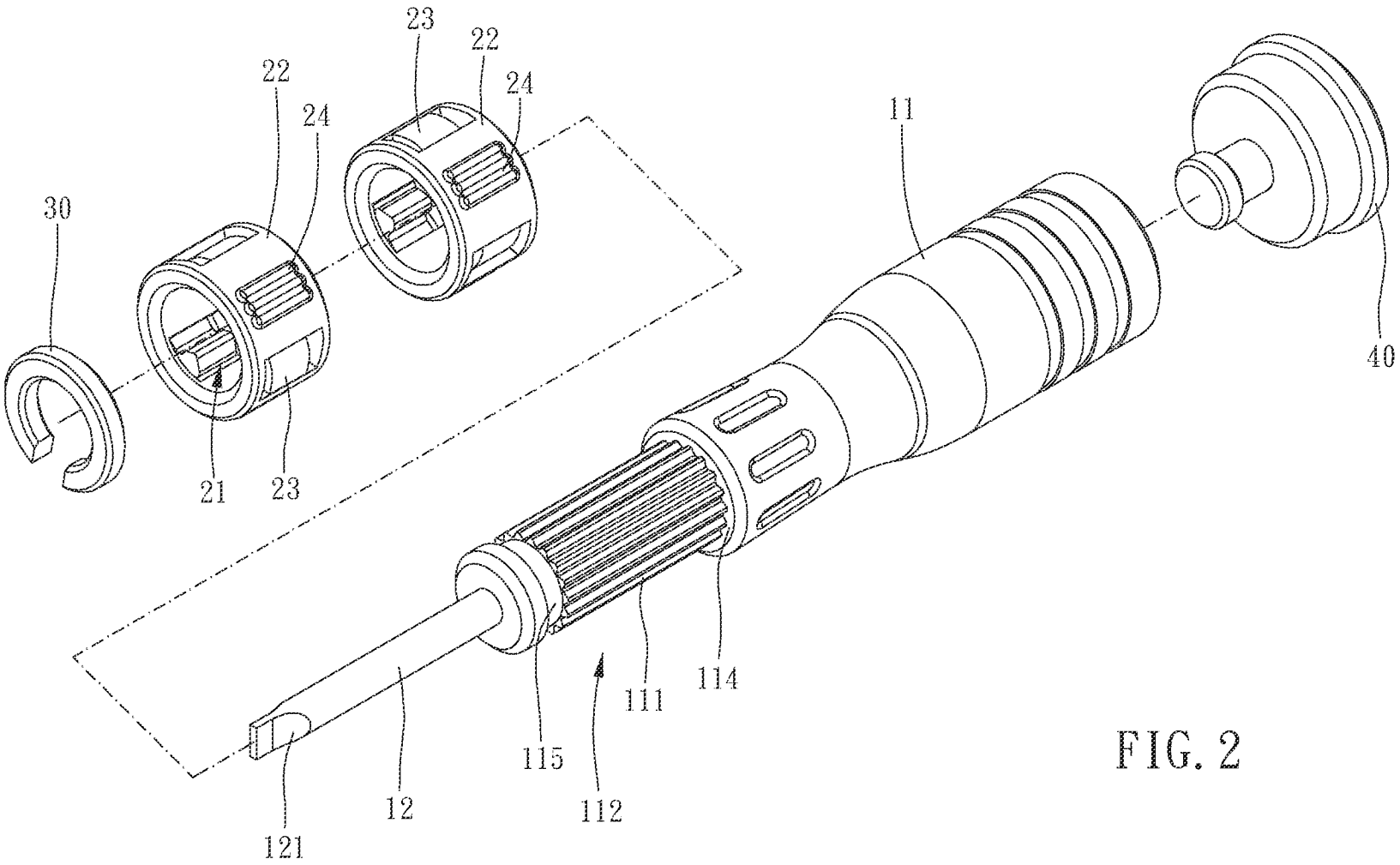
FIG. 2 is a breakdown drawing of a preferable embodiment of the present invention.
Figure 3:
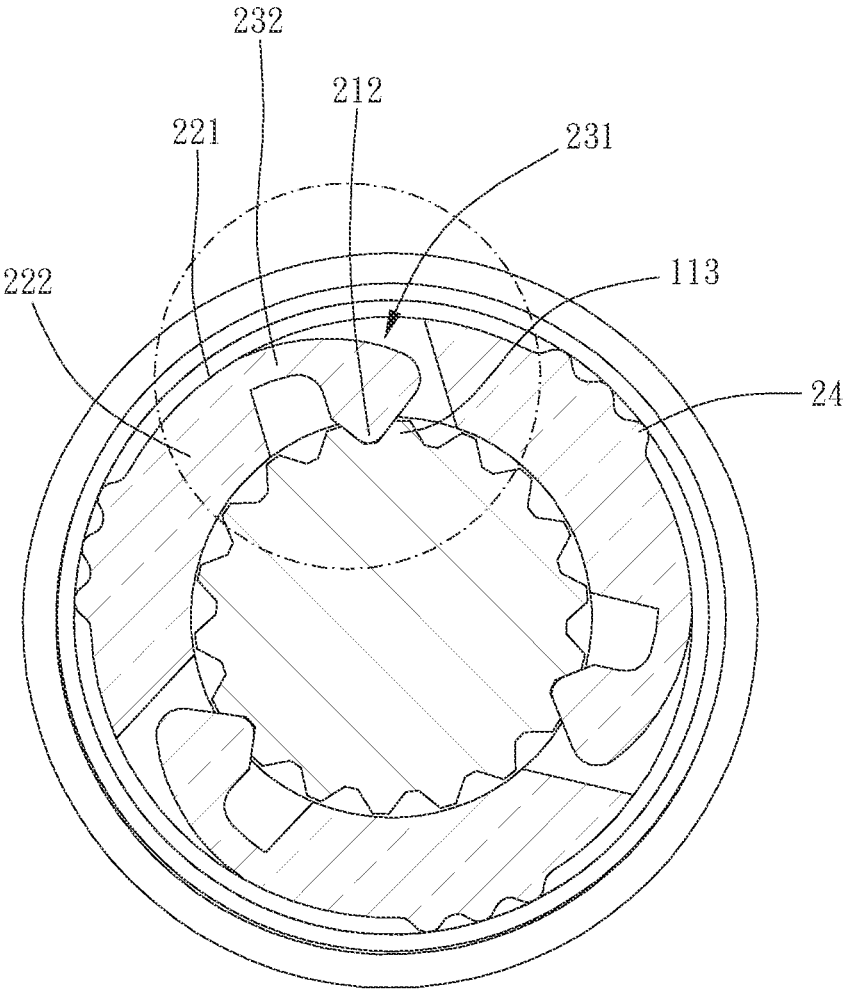
FIG. 3 is a cross-sectional view of a preferable embodiment of the present invention.

Please refer to FIGS. 1 to 6 for a preferable embodiment of the present invention. A ratchet tool 1 of the present invention includes a driver body 10 and at least one sleeve member 20.

The driver body 10 includes a handle 11 and a working rod 12 connected with the handle 11, and at least one of the handle 11 and the working rod 12 is integrally formed with a first blocking structure 111. The at least one sleeve member 20 is disposed around and unidirectionally rotatable about the driver body 10, the at least one sleeve member 20 is integrally formed with a second blocking structure 21, at least one of the first blocking structure 111 and the second blocking structure 21 is configured as a ratcheting structure, and the second blocking structure 21 is releasably stuck with the first blocking structure 111 in a rotation direction of the at least one sleeve member 20. When there is a relative torque greater than a predetermined torque between the at least one sleeve member 20 and the driver body 10, at least one of the second blocking structure 21 and the first blocking structure 111 deforms and the second blocking structure 21 is slidable over the first blocking structure 111 in the rotation direction. Whereby, it is avoided that the driven piece (such as screw or other fastener) is damaged due overdriving of the torque tool. The at least one sleeve member 20 can be rotated in a reverse rotation direction to have a torque larger than the predetermined torque is required.

In this embodiment, the handle 11 is integrally formed of plastic material, and the at least one sleeve member 20 is integrally formed of plastic material and integrally formed with the first blocking structure 111. The plastic member can be made by injection molding, which is fast and convenient; and the plastic member has good structural strength and sufficient deformability, which is applicable for constant torque mechanism. However, at least one of the handle 11 and the at least one sleeve member 20 may be made of metal or other material.

Specifically, the handle 11 includes a first end portion 112, the working rod 12 is connected with the first end portion 112, the at least one sleeve member 20 is disposed around and unidirectionally rotatable about the first end portion 112, and the first end portion 112 is integrally formed with the first blocking structure 111. The second blocking structure 21 includes at least one projection 211, and the at least one projection 211 is integrally formed on an inner face of the at least one sleeve member 20. Specifically, the second blocking structure 21 includes at least one ratchet tooth 212 which is disposed on the at least one projection 211 of the at least one sleeve member. However, the first blocking structure 111 may be disposed on the working rod 12.

Preferably, the first blocking structure 111 includes a plurality of projections 113, providing stable engagement, precise disengagement and constant torque. The plurality of projections 113 are circumferentially and separately arranged on the driver body 10, and the plurality of projections 113 extend in an axial direction of the driver body 10. Specifically, the plurality of projections 113 are circumferentially and equiangularly arranged on the handle 11 and extend axially, which prevents interference of the second blocking structure 21 of the at least one sleeve member 20 and the handle 11 and is advantageous for assembling.

Figure 4:
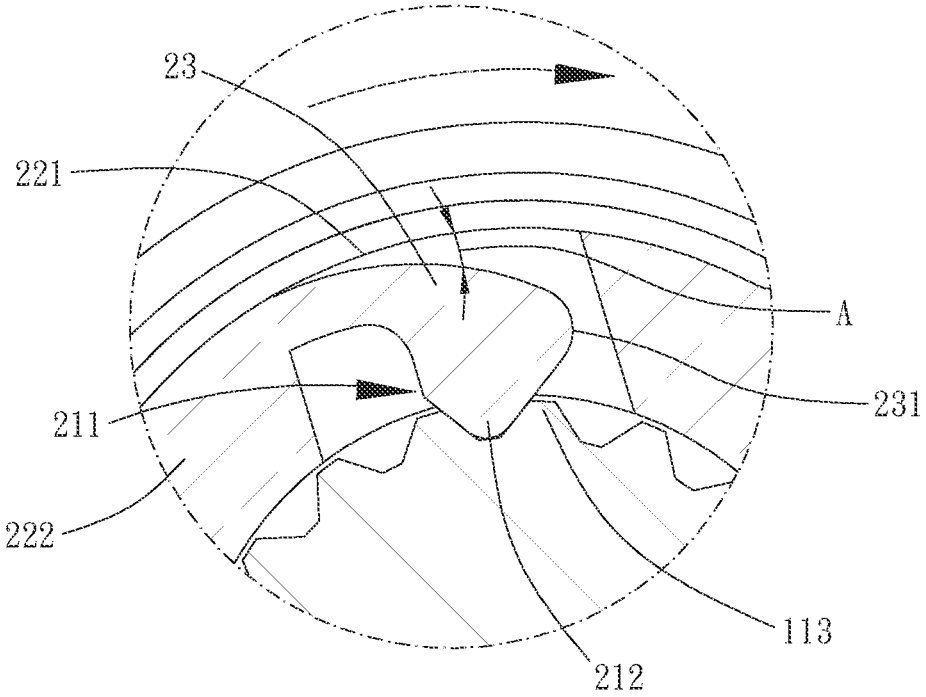
FIGS. 4 to 6 are drawings showing operation of a preferable embodiment of the present invention.
Figure 5:
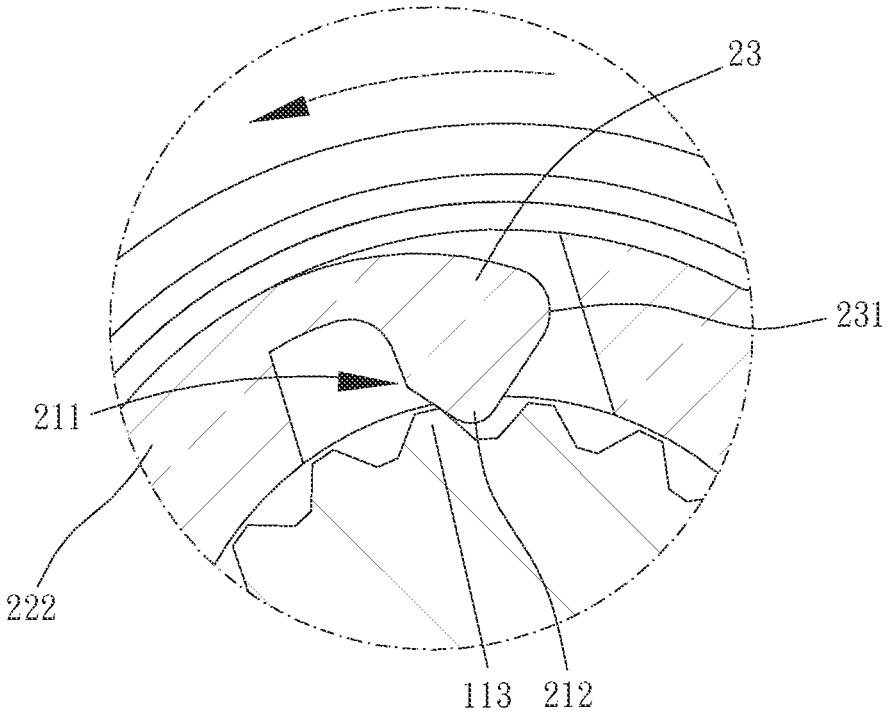

In this embodiment, each of the plurality of projections 113 of the first blocking structure 111 is radially tapered outwardly so that the second blocking structure 21 can slide over the first blocking structure 111 smoothly, stably and precisely; each of the at least one ratchet tooth 212 of the second blocking structure 21 is releasably blocked between adjacent two of the plurality of projections 113 of the first blocking structure 111. As shown in FIG. 4, when a clockwise torque greater than the predetermined torque is applied to the sleeve member 20, the ratchet tooth 212 is blocked by the projection 113 and cannot slide over the projection 113; as shown in FIG. 5, when a counterclockwise torque greater than the predetermined torque is applied to the sleeve member 20, the ratchet tooth 212 is raised by the projection 113 and can slide over the projection 113.

Figure 6:
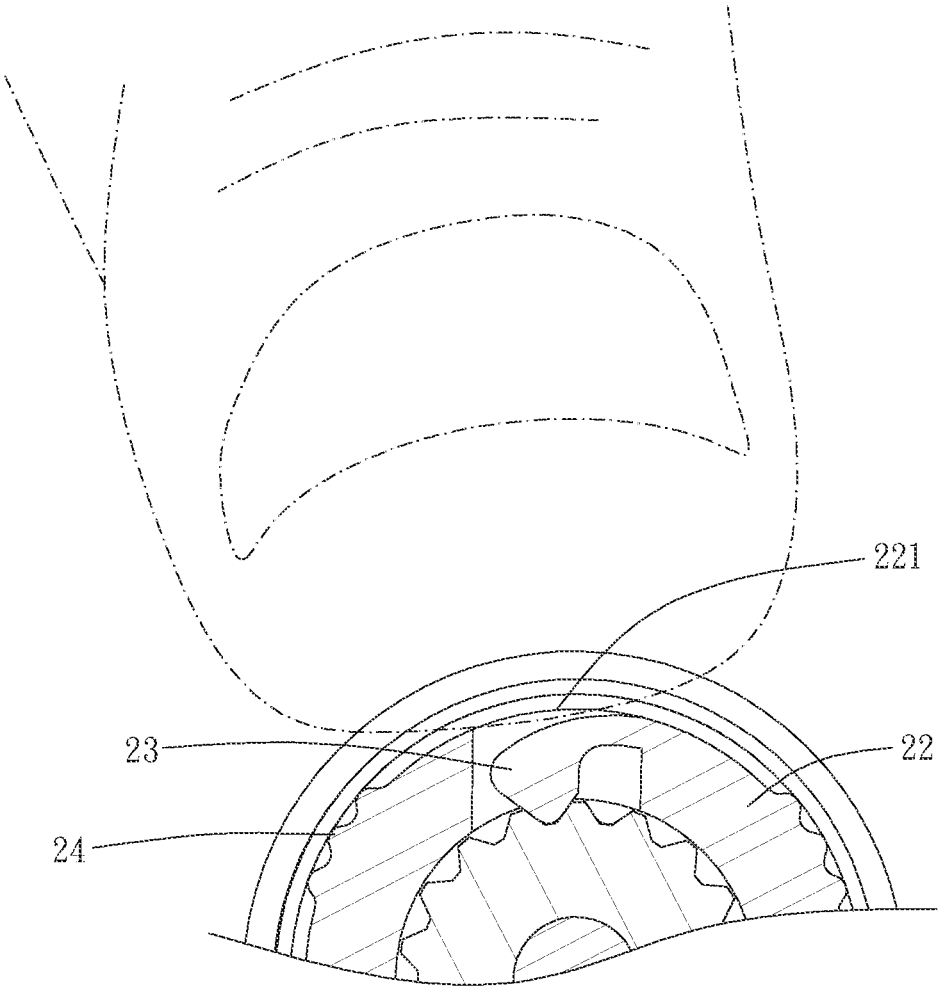

Preferably, the at least one sleeve member 20 is integrally formed and includes a sleeve body 22 and at least one elastic arm 23 connected with the sleeve body 22, and the at least one elastic arm 23 includes the second blocking structure 21. A free end 231 of the at least one elastic arm 23 is inwardly lower than an outer surface 221 of the sleeve body 22, and the second blocking structure 21 is disposed on the free end 231, so that it avoids unintentional press on the at least one elastic arm 23 (FIG. 6). An outer surface of the at least one elastic arm 23 and the outer surface 221 of the sleeve body 22 form an included angle A therebetween, the included angle A increases in a direction toward the free end 231, and this ensures unidirectional rotation of the sleeve member 20. The elastic arm 23 further includes a connection section 232 which is thinner than the circumferential wall 222 of the sleeve body 22 and connected with the circumferential wall 222, and thus the elastic arm 23 can swing well.

In this embodiment, the at least one sleeve member includes two sleeve members 20, and the two sleeve members 20 are unidirectionally rotatable about the driver body 10 in opposite directions, for fastening and unfastening, respectively. The handle 11 further includes a shoulder 114 and an annular groove 115 extending circumferentially, a retainer 30 is positioningly buckled within the annular groove 115, and the two sleeve members 20 are restrictedly located between the shoulder 114 and the retainer 30.

In this embodiment, the working rod 12 is encompassed by the handle 11 and is integrally formed with a screwdriver head 121 (flat head, Philips head, hexagonal head or the like); however, the working rod may be provided with a receiving hole for connection of a screwdriver bit.

Preferably, the at least one sleeve member 20 further includes a plurality of concave-convex structures 24, and the plurality of concave-convex structures 24 are circumferentially and equiangularly arranged on an outer surface of the circumferential wall 222, for gripping the at least one sleeve member 20 firmly; the ratchet tool 1 further includes an end cap 40, and the end cap 40 is rotatably disposed on a distal end of the handle 11 opposite to the working rod 12, wherein the end cap 40 is configured for being abutted on the palm of a hand so that the fingers of the hand can rotate the driver body 10 or the at least one sleeve member 20 easily and quickly.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A ratchet tool, including:

a driver body, including a handle and a working rod connected with the handle, at least one of the handle and the working rod being integrally formed with a first blocking structure; and at least one sleeve member, being disposed around and unidirectionally rotatable about the driver body, integrally formed with a second blocking structure, at least one of the first blocking structure and the second blocking structure being configured as a ratcheting structure, the second blocking structure being releasably stuck with the first blocking structure in a rotation direction of the at least one sleeve member;

wherein when there is a relative torque greater than a predetermined torque between the at least one sleeve member and the driver body, at least one of the second blocking structure and the first blocking structure deforms and the second blocking structure is slidable over the first blocking structure in the rotation direction;

wherein the at least one sleeve member is integrally formed of one piece and includes a sleeve body and at least one elastic arm connected with the sleeve body, and the at least one elastic arm includes the second blocking structure;

wherein a free end of the at least one elastic arm is inwardly lower than an outer surface of the sleeve body, and the second blocking structure is disposed on the free end;

wherein an outer surface of the at least one elastic arm and the outer surface of the sleeve body form an included angle therebetween, and the included angle increases in a direction toward the free end;

wherein the handle is integrally formed of plastic material and integrally formed with the first blocking structure; the at least one sleeve member is integrally formed of plastic material, the at least one sleeve member includes two sleeve members, and the two sleeve members are unidirectionally rotatable about the driver body in opposite directions; the first blocking structure includes a plurality of projections, the plurality of projections of the first blocking structure are circumferentially and equiangularly arranged on the handle; the plurality of projections of the first blocking structure extend in an axial direction of the driver body; each of the plurality of projections of the first blocking structure is radially tapered outwardly; the second blocking structure includes at least one ratchet tooth which is disposed on the at least one sleeve member and releasably blocked between adjacent two of the plurality of projections of the first blocking structure; the handle further includes a shoulder and an annular groove extending circumferentially, a retainer is positioningly buckled within the annular groove, and the two sleeve members are restrictedly located between the shoulder and the retainer; the elastic arm includes a connection section which is thinner than a circumferential wall of the sleeve body and connected with the circumferential wall; and the at least one sleeve member further includes a plurality of concave-convex structures, and the plurality of concave-convex structures are circumferentially and equiangularly arranged on an outer surface of the circumferential wall.

2. The ratchet too of claim 1, wherein the handle includes a first end portion, the working rod is connected with the first end portion, the at least one sleeve member is disposed around and unidirectionally rotatable about the first end portion, and the first end portion is integrally formed with the first blocking structure.

* * * * *